US011766791B2

(12) United States Patent
Fisher

(10) Patent No.: US 11,766,791 B2
(45) Date of Patent: Sep. 26, 2023

(54) UTILITY TOOL

(71) Applicant: Cory Fisher, Waverly, NE (US)

(72) Inventor: Cory Fisher, Waverly, NE (US)

( * ) Notice: Subject to any disclaimer, the term of this patent is extended or adjusted under 35 U.S.C. 154(b) by 0 days.

(21) Appl. No.: 16/996,825

(22) Filed: Aug. 18, 2020

(65) Prior Publication Data

US 2021/0053239 A1 Feb. 25, 2021

Related U.S. Application Data

(60) Provisional application No. 62/888,933, filed on Aug. 19, 2019.

(51) Int. Cl.

| | |
|---|---|
| ***B26B 11/00*** | (2006.01) |
| ***E04F 21/32*** | (2006.01) |
| ***E04F 21/165*** | (2006.01) |

(52) U.S. Cl.

CPC ..... *B26B 11/006* (2013.01); *E04F 21/1652* (2013.01); *E04F 21/32* (2013.01)

(58) Field of Classification Search

CPC .. B26B 1/02; B26B 1/04; B26B 1/042; B26B 1/044; B26B 11/006; B26B 11/00; B26B 11/001; B26B 1/00; B26B 1/046; B26B 1/048; B26B 1/06; E04F 21/1652; E04F 21/32

USPC ..... 7/158; 30/153, 155–161

See application file for complete search history.

(56) References Cited

U.S. PATENT DOCUMENTS

| | | | | |
|---|---|---|---|---|
| 10,632,632 | B1 * | 4/2020 | Demko | B26B 1/048 |
| 2006/0288584 | A1 * | 12/2006 | Chu | B26B 1/04 30/153 |
| 2015/0352731 | A1 * | 12/2015 | France | B26B 1/048 30/159 |
| 2016/0121493 | A1 * | 5/2016 | Ikoma | B26B 1/048 30/161 |
| 2020/0189087 | A1 * | 6/2020 | Henke | B26B 11/006 |
| 2020/0361071 | A1 * | 11/2020 | Lopez | B25F 1/04 |

* cited by examiner

*Primary Examiner* — Don M Anderson
*Assistant Examiner* — Caleb Andrew Holizna

(57) ABSTRACT

A utility tool with at least one blade that is capable of being disposed at least partially within the body of the utility tool. The at least one blade may swivel around an access of rotation and engage with a locking mechanism to keep the blade secure when in use and secure in the body when in a closed position.

17 Claims, 9 Drawing Sheets

UTILITY TOOL

CLAIM OF PRIORITY

This application claims the benefit of and priority to U.S. Provisional Application Ser. No. 62/888,933, the entirety of which is incorporated by reference.

BACKGROUND

Flexible blades are used in a variety of applications, including painting and dry wall. Flexible blades can be sized and shaped for different applications. For example, some blades are sized and shaped for quick application of material (e.g., putty or drywall mud), while other blades are sized and shaped for more detailed finishing work.

Some known flexible blades are limited to single blade tools. For example, a putty tool with a unitary body and blade is typical. This design, however, requires a tradesperson to use and carry multiple tools. This leads to difficulty in efficiently managing jobs, as it is easy to misplace or leave a tool away from immediate reach when multiple tools are required for a job. Further, having to store the multiple tools in tool box or tool belt increases storage problems (e.g., not enough space and disorganization). Thus, it is desired to develop a tool that can be used in multiple applications, with minimal storage requirements.

It is with respect to these and other considerations that the technology is disclosed. Also, although relatively specific problems have been discussed, it should be understood that the embodiments presented should not be limited to solving the specific problems identified in the introduction.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Aspects of the technology relate to a utility tool having one or more blades that are pivotally coupled to an end, such as a top end, of an assembly body. In an example, the blades pivot about an axis of rotation located on the top end of the assembly body such that blades may fully or partially recess into an opening of the assembly body of the tool. A locking mechanism having a blade engagement member may be used to selectively lock one or more elements of the blade to secure and engage the blade in either a fully open position (e.g., an extended position where a tradesperson can use the blade) or a closed position whereby the blade is disposed substantially within the assembly body. As such, in aspects of the technology, a tradesperson could unlock the locking mechanism and release the blade engagement member, select a blade from the one or more blades housed within the assembly body, and secure the selected blade in the open position and the non-selected blades in the closed position by reengaging the blade engagement member in the locked position. When finished with the particular blade, the tradesperson could then select an alternative blade, in aspects, by releasing the blade engagement member, rotating the alternative blade to the open position, rotating the pervious blade to the closed position, and reengaging the blade engagement member. Further, a tradesperson could then house all blades at least partially within the assembly body by releasing the blade engagement member, rotating the selected bladed to the closed position, and reengaging the blade engagement member.

Aspects of the technology relate to a utility tool that includes a body. The body, in examples, includes a front side opposite a back side and at least one side surface disposed between the front side and the back side. The body further includes a top end opposite a proximate end. The body further includes an opening defined by the body, the opening extending through at least a portion of the at least one side surface. The body additionally includes a first blade having a pivot end and a distal end, the pivot end disposed within the opening and rotatably coupled to the top end such that the first blade is capable of being rotated about an axis, wherein the first blade includes a securing notch. The body further includes a channel disposed within the front side of the body. The body further includes a blade engagement member disposed at least partially within the channel and engagable with a securing notch of the first blade; and a biasing element disposed within the body and coupled to the blade engagement member.

The utility tool may also include one or more of the following additional elements: the first blade further that has a blade protrusion disposed opposite the securing notch; the first blade flares outwardly from the pivot end to the distal end such that the pivot end is narrower than the distal end; the second blade has a second pivot end and a second distal end, and the second pivot end is disposed within the opening and rotatably coupled to the top end such that the second blade is capable of being rotated about the axis; the first blade is rotatably coupled to the top end of the body via a pivot pin, and the pivot pin includes a binding post and a fastener, and the first blade has a bore at the pivot end of the first blade that receives at least a portion of the binding post; the first blade is at least 90% disposed within the body when the first blade is rotated about the axis to a closed position; and/or a clip coupled to the front side of the body.

Additional/alternative aspects of the technology include a utility tool that includes a body. The body may include a first end and an opposite second end extending along a longitudinal axis. The utility tool may also comprise an elongated opening defined within the body and extending from the first end towards the second end and substantially along the longitudinal axis. The utility tool may include a pivot pin disposed at the first end and extending at least partially through the opening, wherein the pivot pin defines a rotational axis. The utility tool may further include at least one blade rotatably coupled to the first end at the pivot pin, wherein the at least one blade is moveable between a closed configuration and an extended position. The utility tool may by such that in the closed configuration the at least one blade is disposed within the opening of the body, and in the extended position the at least one blade extends at least partially out of the opening of the body. The utility tool may further include a locking mechanism that is moveable between a locked configuration and an unlocked configuration, wherein in the locked configuration, the locking mechanism engages with the at least one blade such that the at least one blade is locked either in the closed configuration or the extended configuration, wherein in the unlocked configuration, the locking mechanism disengages with the at least one blade such that the at least one blade is rotatable about the rotational axis out of the opening, and wherein the locking mechanism is biased towards the locked configuration.

The utility tool may also include one or more of the following additional elements/features: the movement of the locking mechanism between the locked configuration and the unlocked configuration is substantially parallel to the longitudinal axis; the locking mechanism comprises a blade engagement member and a biasing element, wherein the blade engagement member is configured to engage with at least one side of the at least one blade; the biasing element comprises a compression spring; the at least one side of the at least one blade member comprises a securing notch; the locking mechanism in in the locked configuration and the at least one blade is in the extended position, the locking mechanism engages with the at least one blade to define a full extended position and prevent further rotation about the rotational axis; a side of the at least one blade member comprises a protrusion, and wherein the protrusion engages with the locking mechanism in the full extended position; at least one blade comprises a first blade, a second blade, and a third blade; a distal end of each of the three blades has a different width; the distal end of each of the three blades are centered with respect to the pivot pin; each of the three blades have a substantially equal length; at least one blade of the utility tool is flexible; and/or the at least one blade is completely disposed within the body when in the closed configuration.

BRIEF DESCRIPTION OF THE DRAWINGS

The following drawing figures, which form a part of this application, are illustrative of aspects of systems and methods described below and are not meant to limit the scope of the disclosure in any manner, which scope shall be based on the claims.

Figure 1:
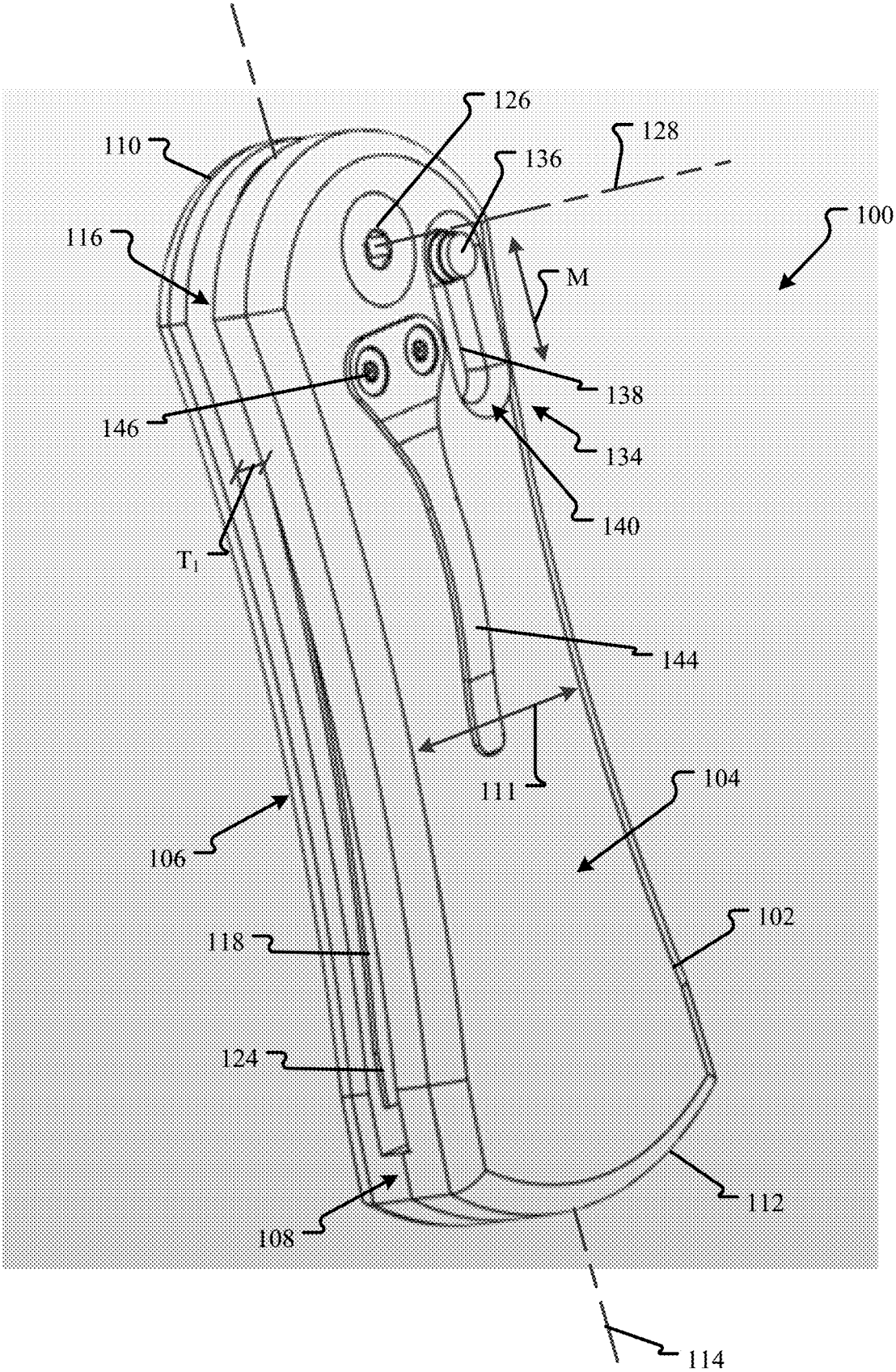
FIG. 1 illustrates a perspective view of an example multi-blade utility tool in a closed and locked position.

While embodiments of the disclosure are amenable to various modifications and alternative forms, specific embodiments have been shown by way of example in the drawings and are described in detail below. The intention is not to limit the scope of the disclosure to the particular embodiments described. On the contrary, the disclosure is intended to cover all modifications, equivalents, and alternatives falling within the scope of the disclosure and the appended claims.

DETAILED DESCRIPTION

Although the device discussed in detail below may be implemented for a variety of utility blades, the present disclosure will discuss the implementation of this tool with respect to drywall blades, sometimes referred to as scrapers. A person of skill in the art will understand that the technology described in the context of drywall blades could be adapted for use with other tools such as any utility tools used in home renovation or repair, construction, and indoor and outdoor activities.

The multi-blade utility tool discussed herein may be used to solve a variety of technological challenges. In non-exclusive and non-limiting examples, aspects of the technology allow for a user to switch between blades of varying shapes, which may be useful for specific tasks of a job, with relative ease and efficiency. For example, a blade of the multi-blade utility tool may have a top end which is larger than a middle section (e.g., a broad knife design). This design of the blade allows, in aspects of the technology, for a tradesperson to apply a large amount of a material (e.g., drywall mud to a wall). Another blade of the multi-blade utility tool may have a relatively uniform, narrow width from a base to the top end (e.g., a taping blade). This substantially straight design may allow a tradesperson to apply the material with more detail. The multi-blade utility tool described below, in aspects, allows a tradesperson to switch between relatively quickly and efficiently between these or other blades of the multi-blade utility tool. The ability to switch relatively quickly and efficiently between these blades may allow a tradesperson to complete the job with relative ease and efficiency. With these broad concepts in mind, several examples of a multi-blade utility tool are described below.

FIG. 1 illustrates a perspective view of an example multi-blade utility tool 100 in a closed and locked position. As shown, the multi-blade utility tool 100 has an assembly body 102. The assembly body 102, in aspects of the technology, may be employed as a handle during use of the multi-blade utility tool 100. The assembly body 102 may be formed from a variety of materials, such as plastic, metal, woods, or other durable material, or a combination of these materials. The material may be selected for durability, resistance to corrosion, and comfort. The assembly body 102 includes a front side 104 and an opposite back side 106 with at least one side surface 108 disposed therebetween.

It should be appreciated that throughout this description, references to orientation and/or direction (e.g., front(ward), back(ward), top, bottom, rear, right, left, upper, lower, etc.) of the utility tool relate to its position as illustrated in the drawings and are used for ease of description only. No restriction is intended by use of the terms regardless of how the utility tool is situated on its own.

Additionally, the assembly body 102 may have a surface coating (not shown) that addresses a variety of potential problems that could be faced when using the multi-blade utility tool 100. For example, a rubberized coating may be added to increase friction and allow for a better grip when the utility tool 100 is in use, an anti-corrosive coating may be applied to prevent corrosion during cleaning or water immersion, and/or an insulating coating may be applied to promote comfortable tool temperatures. A variety of different coatings may be applied to the same or different areas of the assembly body 102 as required or desired. For example, an anti-corrosive coating may be applied to the entire assembly body 102, whereas a grip coating may be applied to portions of the center front side 104 and the back side 106 of the assembly body where a user is likely to interact with the assembly body 102.

In addition to coatings, the assembly body 102 may be shaped to provide comfort to a user of the multi-blade utility tool 100 and provide any functional shape capable of substantially housing one or more blades when the multi-blade utility tool 100 is in a closed position. For example, the assembly body 102 may be a substantial cuboidal prism.

As illustrated, the assembly body 102 has the front side 104, the back side 106, the side surface 108, a top end 110, and a proximate end 112. The top end 110 and the proximate end 112 are illustrated as being substantially rounded with a wider width than a center portion 111. The width being measured perpendicular to a longitudinal axis 114 extending between the top end 110 and the proximate end 112. Between the top end 110 and the proximate end 112, the assembly body 102 may taper inward toward the center portion 111 such that the narrowest width of the assembly body 102 may be positioned between the top end 110 and the proximate end 112 (e.g., at or around the center portion 111). For example, as illustrated, the assembly body 102 has a bulged top end 110 and a bulged proximate end 112 that flare slightly out from the center portion 111 of the assembly body 102. The narrowest width of the assembly body 102 may be positioned at the center portion 111 of the assembly body 102 or the narrowest portion of the assembly body 102 may be offset (e.g., towards the top end 110 or the proximate end 112) from the center portion 111. The shape and size of the assembly body 102 may be selected such that the widest blade of the multi-blade utility tool 100 is substantially recessed and disposed fully within the assembly body 102 when in the closed position.

Figure 5:
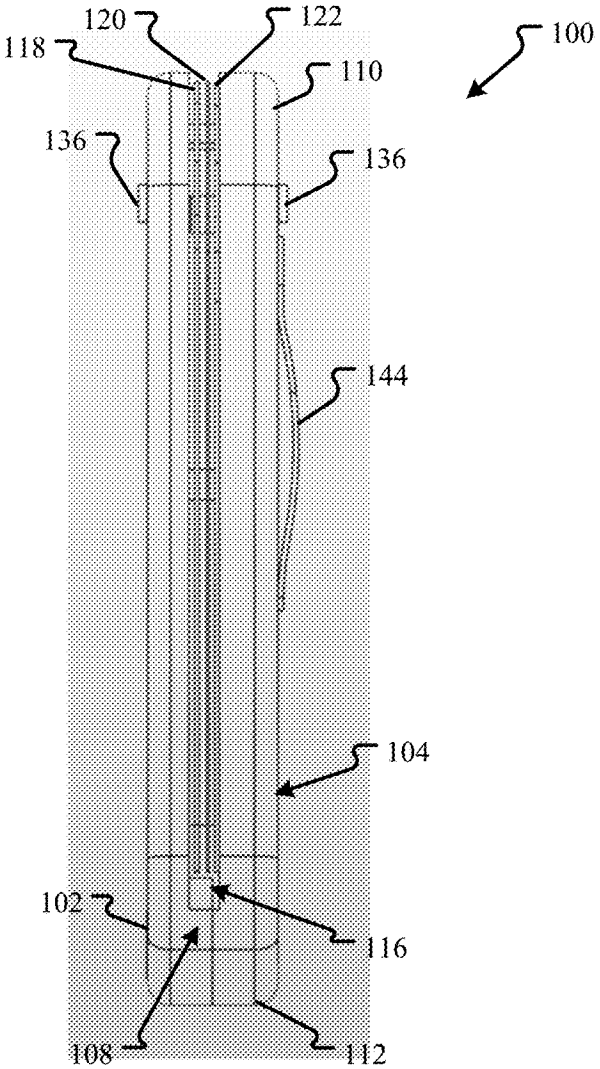
FIG. 5 illustrates a right-side view of the multi-blade utility tool in a closed and locked position.

The side surface 108 of the assembly body 102 may have an opening 116 that is defined within the assembly body 102 and sized and shaped to house one or more blades, such as a first blade 118, a second blade 120, and a third blade 122 (the second and third blades are shown in FIG. 5), while the blade of the multi-blade utility tool 100 is in the closed position. As used herein, when the multi-blade utility tool 100 is referred to as being in the closed position or configuration, all blades, including first blade 118, are substantially inside of the assembly body 102, such that all or most of the blades of the multi-blade utility tool 100, including the first blade 118, is disposed within the opening 116 of the assembly body 102. In an example, the first blade 118 can be at least 90% disposed within the assembly body 102 when in the closed position.

As illustrated, the opening 116 is elongated and extends from the top end 110 in a direction towards the proximate end 112 and substantially along the longitudinal axis 114. Additionally, the opening 116 is defined in the shown side surface 108 in FIG. 1 and extends towards the opposite side surface that is not shown. In the example, the opening 116 is only defined in the top end 110 and one side surface 108 such that the opposite side surface and the proximate end 112 are at least partially enclosed. In other examples, the opening 116 may also extend through both side surfaces. Additionally or alternatively, more or less sides may exist on the assembly body 102, depending on the shape of the assembly body 102. Indeed, a side of the assembly body 102 may be curved such that there only exists one side surface 108.

The size and shape of the opening 116 may allow access by a user of the multi-blade utility tool 100 to the blades recessed in the assembly body 102 when the blades are in the closed position. For example, the opening 116 may have a thickness $T_1$ along the side surface 108 of the assembly body 102 that is larger than the total stacked thickness $T_2$ (shown in FIG. 4) of all blades. This, in aspects, may allow access to one or all of the blades housed in the assembly body 102 using the opening 116. As another example, the opening 116 may have varying thicknesses $T_1$ along the side surface 108 of the assembly body 102, with at least one portion of the opening 116 having a thickness wide enough for a user to grab any or all blades at the location of the widest portion of the opening 116.

Additionally or alternatively, any or all of the blades of the multi-blade utility tool 100 may have a projection or other feature to allow a user to grasp and move the blade from the open or closed position. For example, a distal end 124 of the first blade 118 may be sized and shaped to facilitate access to the blade by a user while the multi-blade utility tool 100 is in the closed position. In an aspect, the first blade 118 may have at least one portion (not shown) that projects out of the opening 116 when in the closed position. This may be accomplished by one or more sections of the first blade 118 having a width such that it projects out of the opening 116. In another aspect, the first blade may have at least one thumbnail recess (no shown) that may allow a user to more easily grasp the first blade 118. As such, the user may grab or interact with the projection or other feature for ease of use. In aspects of the technology, each blade in the multi-blade utility tool 100 may have the projections or other features at different locations than the other adjacent blades to allow a user access to a single blade of their choice, without requiring a user to access all blades to thereafter return unneeded blades to the closed position.

A pivot pin 126 is disposed at the top end 110 of the assembly body 102 and extends between the front side 104 and the back side 106, and through the opening 116. The pivot pin 126 defines a rotational axis 128. A pivot end 130 (shown in FIG. 8) of each blade 118, 120, 122 is rotatably coupled to the multi-blade utility tool 100 at the top end 110 via the pivot pin 126 and within the opening 116 between the front and back sides 104, 106. As an example, the first blade 118 may have a bore 132 (shown in FIG. 8) in which the pivot pin 126 is extends through the first blade 118. In the example, the pivot pin 126 is fixed to the assembly body 102 such that the blades rotate relative to the pin 126 and about the rotational axis 128. In other examples, the pivot pin 126 may at least partially rotate relative to the assembly body 102 and the pivot end of the blades are fixed to the pin 126 so as to enable rotation of the blades about the rotational axis 128. The rotational axis 128 is substantially orthogonal to the longitudinal axis 114.

In the example, the pivot pin 126 may be removable from the assembly body 102. In aspects of the technology, removably coupling the pivot pin 126 to the assembly body 102 allows a user to add or remove blades to the multi-blade utility tool 100 as required or desired. Additionally or alternatively, the assembly body 102 may be formed by two components, a front side component and a back side component (shown in FIG. 12), that can be removably coupled together via the pivot pin 126. This configuration allows for access within the opening 116 so that various components can be cleaned, repaired, and/or replaced as required or desired.

Figure 10:
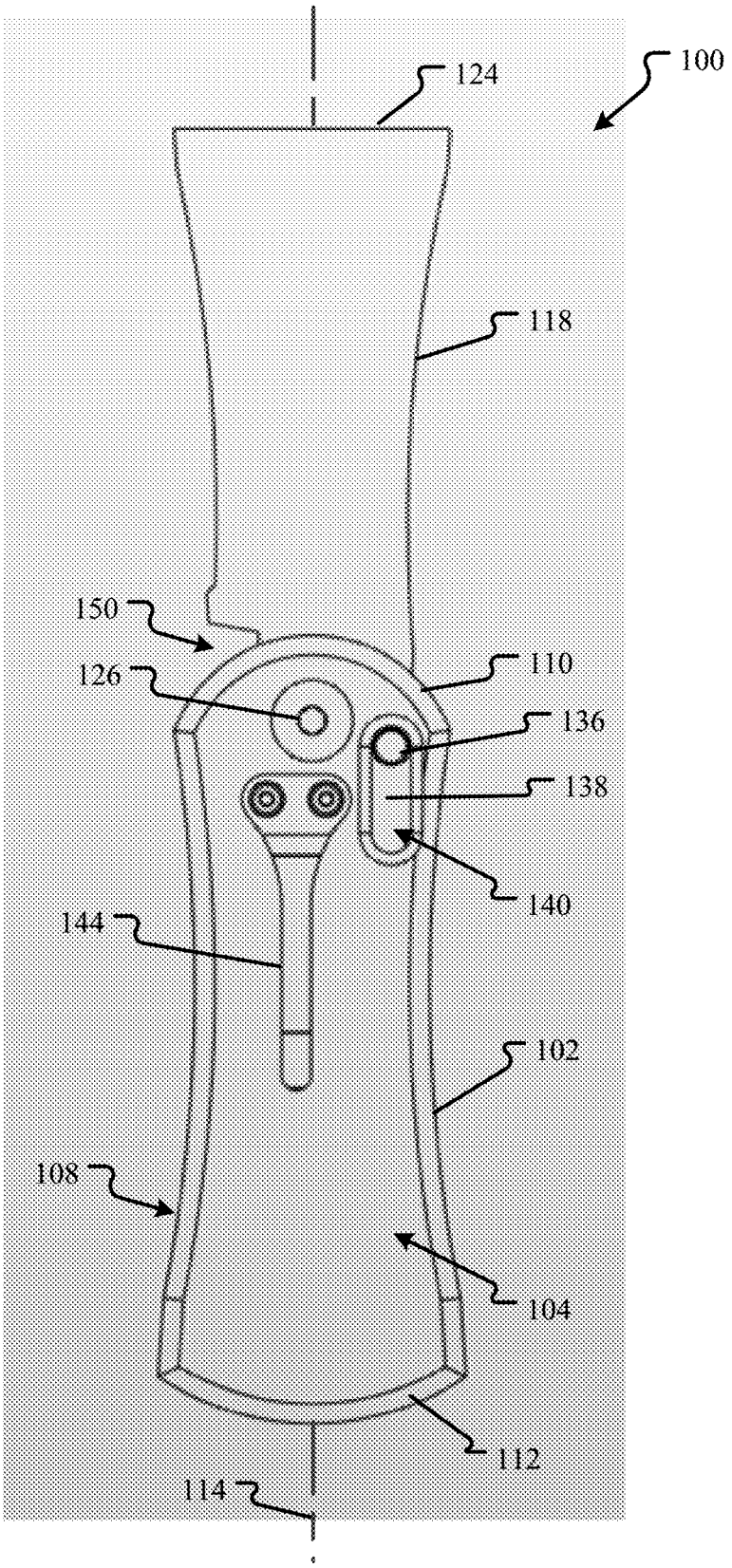
FIG. 10 illustrates a front view the multi-blade utility tool with a first blade in an open and locked position.

The multi-blade utility tool 100 includes a locking mechanism 134 that is configured to lock one or more of the blades in the closed position and the open position (shown in FIG. 10). The locking mechanism 134 is disposed at least partially within the opening 116 and offset from the pivot pin 126. The locking mechanism 134 includes at least one extension 136 that is accessible from the exterior of the assembly body 102 and a blade engagement member 138 that is disposed within the opening 116. Both the front and back sides 104, 106 include an elongated channel 140 that slidably receives the extension 136. The elongated channel 140 extends substantially parallel to the longitudinal axis 114. In some examples, the extension 136 may be at least partially recessed within the front and/or back side 104, 106. In other examples, the extension 136 may protrude from the front and/or back side 104, 106.

As illustrated in FIG. 1, the extension 136 of the locking mechanism 134 is positioned within the channel 140 so that it is towards the top end 110 of the utility tool 100. When the locking mechanism 134 is disposed in this position, the blade engagement member 138 is engaged with the blades so as to prevent rotation about the rotational axis 128. To unlock the blades and enable rotational movement, the extension 136 of the locking mechanism 134 can be moved M towards the other end of the channel 140 (shown in FIG. 11) so that it is towards the proximate end 112 of the utility tool 100. When the locking mechanism 134 is disposed in this position, the blade engagement member 138 is disengaged with the blades. The locking mechanism 134 is described further below.

The channel 140 may be any number of shapes and sizes capable of facilitating the locking mechanism 134 to move between at least two positions, namely, the locked position (shown in FIG. 1) and the unlocked position. In an example, the channel 140 is an elongated oval shape that runs substantial parallel to the longitudinal axis 114 and extends through the entire front and/or back side 104, 106. In the example, both the front and back sides 104, 106 enable access and operation of the locking mechanism 134. In other examples, only one of the sides 104, 106 may enable access and operation of the locking mechanism 134. The extension 136 extends from the blade engagement member 138 and is received within the channel 140 so that the user may interact with the locking mechanism 134 and use the extension 136 to engage or disengage (e.g., lock and unlock) the blade engagement member 138 from any or all blades in the multi-blade utility tool 100.

In aspects of the technology, the locking mechanism 134 is biased so as to automatically return to the locked position. This ensures that the blades, whether open or closed are locked in place and rotation about the pivot pin 126 is prevented. The position of the extension 136 inside of the channel 140 defines whether or not the blade engagement member 138 is engaging with one or more blades of the multi-blade utility tool 100 and also provides a visual indication of the locked and unlocked configurations of the locking mechanism 134. For example, if the locking mechanism 134 is positioned in the locked position end (e.g., towards the top end 110), then the blades will be locked in either the closed or open position, depending on which position the blades are currently oriented at the time the blade engagement member 138 enters the locked position. Alternatively, if the locking mechanism 134 is in the free rotation position (e.g., towards the proximate end 112), then the blades will not be locked and may otherwise be freely rotated as required or desired.

Figure 9:
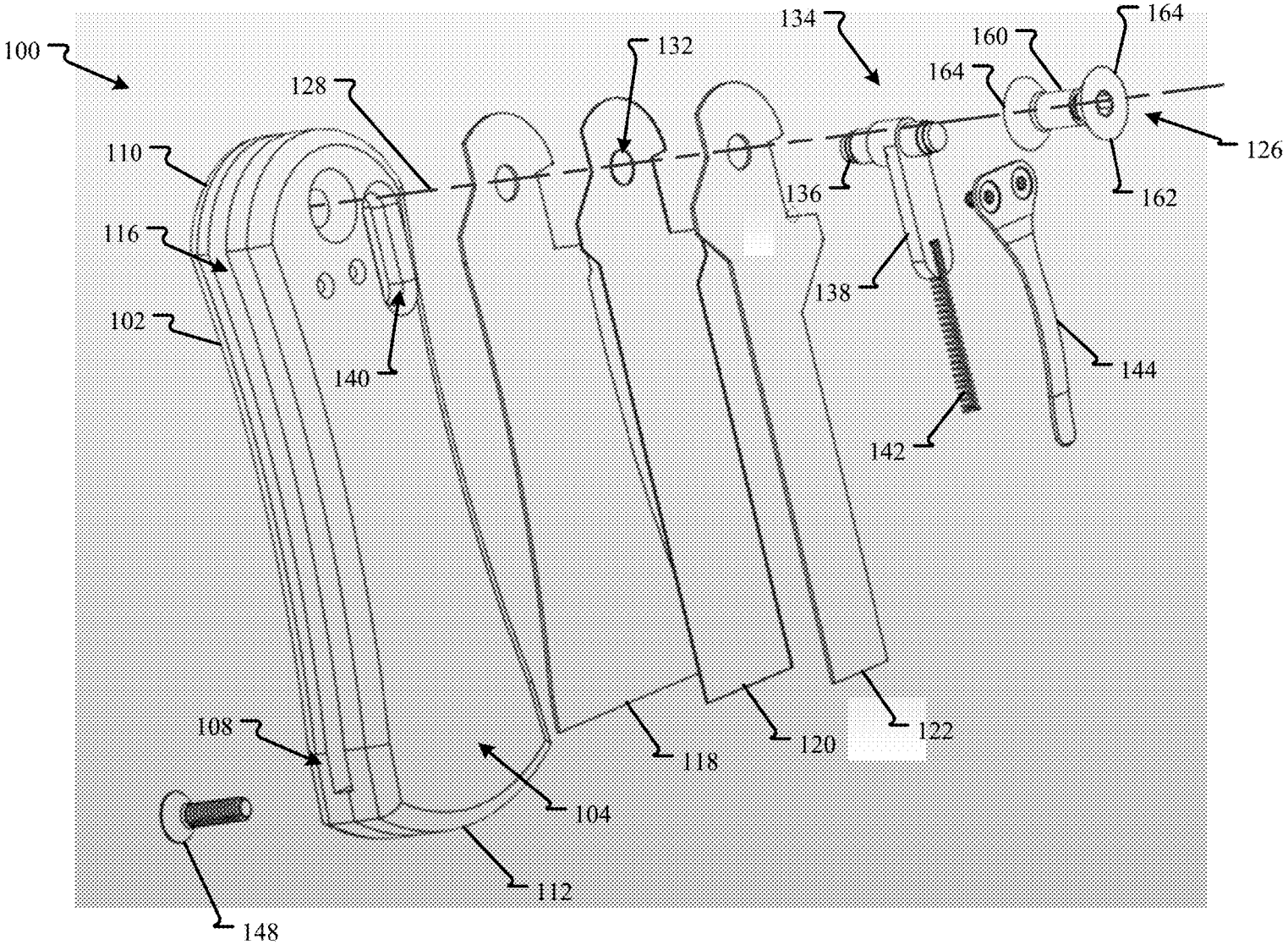
FIG. 9 illustrates a perspective exploded view of the multi-blade utility tool.

In the example, the blade engagement member 138 may engage with a biasing element 142 (shown in FIG. 9). The biasing element 142 provides a biasing force in a directional vector extending at least partially in a direction toward the top end 110 of the assembly body 102. In an aspect, the biasing element 142 is a compression spring disposed within the assembly body 102. Such force by the biasing element 142 on the blade engagement member 138 automatically urges the blade engagement member 138 towards the locked position when there are no other forces on the locking mechanism 134. Thus, at least a second force is needed to overcome the biasing element 142 (e.g. a force exerted on the extension 136) to move the blade engagement member 138 to the unlocked position from the locked position. For example, a user of the multi-blade utility tool 100 could exert this second force to position the blade engagement member 138 in the unlocked position and enable rotation of one or more of the blades. Upon release of the extension 136 the blade engagement member 138 will automatically return to the locked position via the biasing element 142.

For ease of use and storage, a clip 144 may be coupled to the assembly body 102. The clip 144 is configured to allow a user to couple the multi-blade utility tool 100 to an object, such as a belt, pocket, tool storage container, or other organizational or convenient object. The clip 144 may be a variety of shapes and/or sizes to frictionally fit on a variety of objects. As illustrated, the clip 144 has an elongated strip that runs substantially parallel to the longitudinal axis 114 with a curvature in the elongated strip that creates a gap between the strip and the front side 104 of the assembly body 102 along some portions of the elongated strip. One or more clip fasteners 146 may be used to removably couple the clip 144 to the assembly body 102 to allow the clip 144 to flex without decoupling from the assembly body 102.

Figure 3:
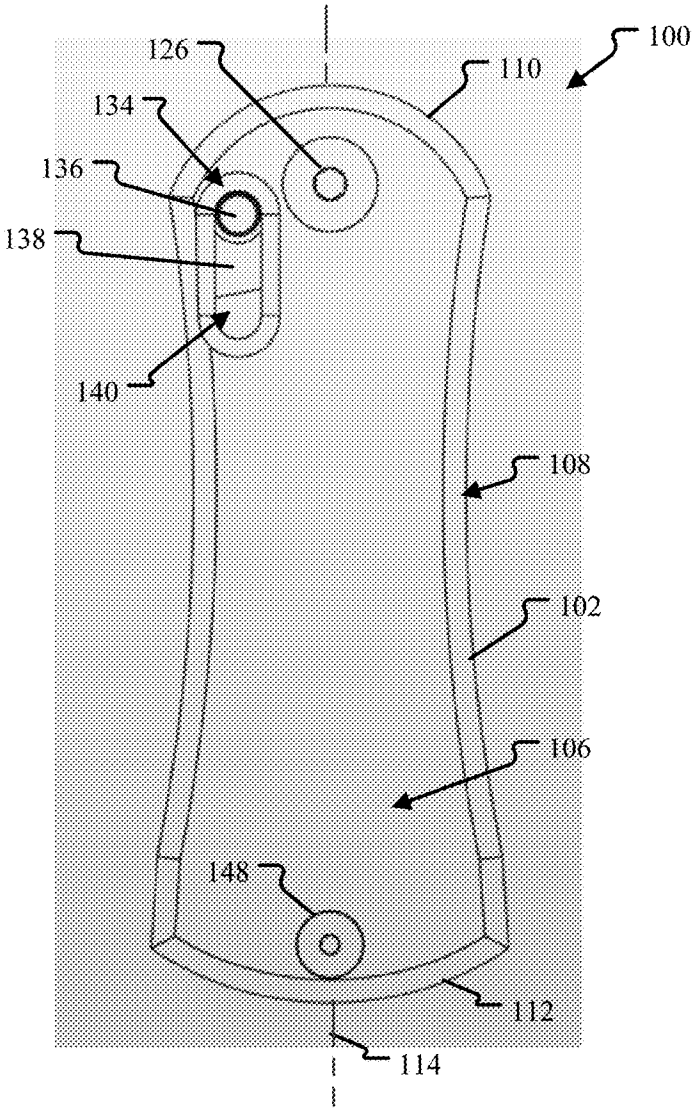
FIG. 3 illustrates a back view of the multi-blade utility tool in a closed and locked position.
Figure 2:
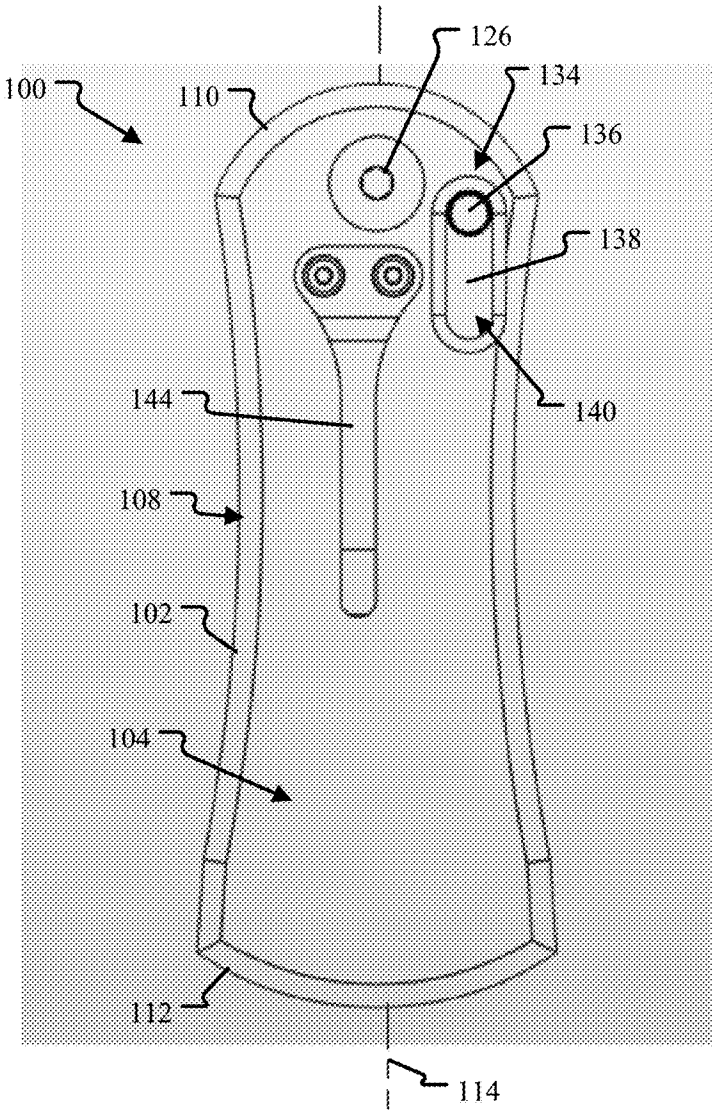
FIG. 2 illustrates a front view of the multi-blade utility tool in a closed and locked position.

FIG. 2 illustrates a front view of the multi-blade utility tool 100 in a closed and locked position. FIG. 3 illustrates a back view of the multi-blade utility tool 100 in a closed and locked position. Referring concurrently to FIGS. 2 and 3, a number of components are described above in reference to FIG. 1, and thus, are not necessarily described further. In the example, the pivot pin 126 is positioned on the top end 110 of the assembly body 102 and centered along the longitudinal axis 114. The front and back sides 104, 106 of the assembly body 102 may have a symmetric shape about the longitudinal axis. However, the shape of the assembly body 102 may be non-symmetric to substantially house a variety of shapes of blades of the multi-blade utility tool 100 as required or desired.

The channel 140 lies substantially parallel to the longitudinal axis 114, but offset therefrom. The location of the channel 140 is opposite of the side surface 108 that the opening 116 (shown in FIG. 1) is formed in and coincides with an element of the blades to provide locking engagement when the blades are in the closed position (as shown) and in the open position (shown in FIG. 10). The channel 140 can be formed on both the front and back sides 104, 106 of the assembly body 102 so that the locking mechanism 134 can be accessible from either side of the utility tool 100. As such, the blade engagement member 138 can have a pair of opposing extensions 136, each extending from one side. The blade engagement member 138 may extend through the opening 116 (shown in FIG. 1) of the assembly body 102 in order to engage with all blades in the multi-blade utility tool 100, because each blade is positioned at a different depth inside of the assembly body 102. The extension 136 may extend substantially perpendicular to the front or back side 104, 106 of the assembly body 102.

Additionally, the clip 144 may be positioned at multiple locations and extending in multiple directions along the assembly body 102 as required or desired. In this illustration, the clip 144 is coupled to the front side 104 of the assembly body 102 off-center from the longitudinal axis 114, and positioned proximate to the top end 110, with the elongated strip extending towards the proximate end 112 in a direction substantially parallel to the longitudinal axis 114. As described above, the assembly body 102 can be formed from two or more components. In this example, a body coupling fastener 148 extends through the back side component 106 and into the front side component 104 so as to couple the assembly body 102 together. Additionally, this enables for the assembly body 102 to be disassembled as required or desired. The body coupling fastener 148 may be positioned opposite of the pivot pin 126 towards the proximate end 112 as required or desired. Additionally or alternatively, the pivot pin 126 may include removable fasteners and a binding post (shown in FIG. 9) so as to couple the top end 110 of the assembly body 102 together.

In the example, the back side 106 of the assembly body 102 is substantially the same shape and size as the front side 104. In other examples, the back side 106 may have a different size and/or shape that the front side 104. For example, if the multi-blade utility tool 100 holds blades of increasing size, and assuming that blades are positioned from smallest to largest from the front side 104 to the back side 106, then the front side 104 could have a smaller surface area than the back side 106.

Figure 4:
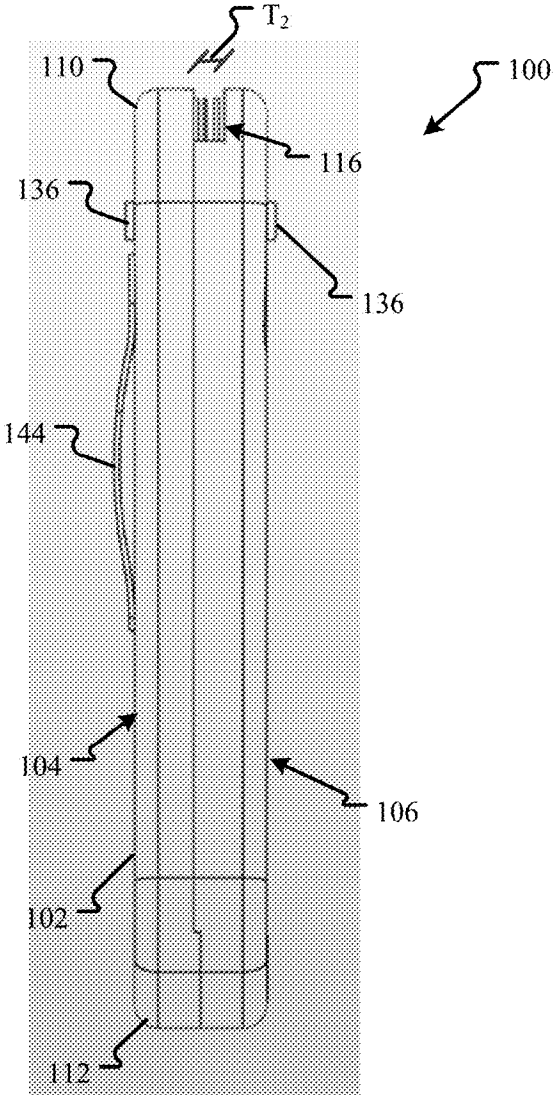
FIG. 4 illustrates a left-side view of the multi-blade utility tool in a closed and locked position.
Figure 6:
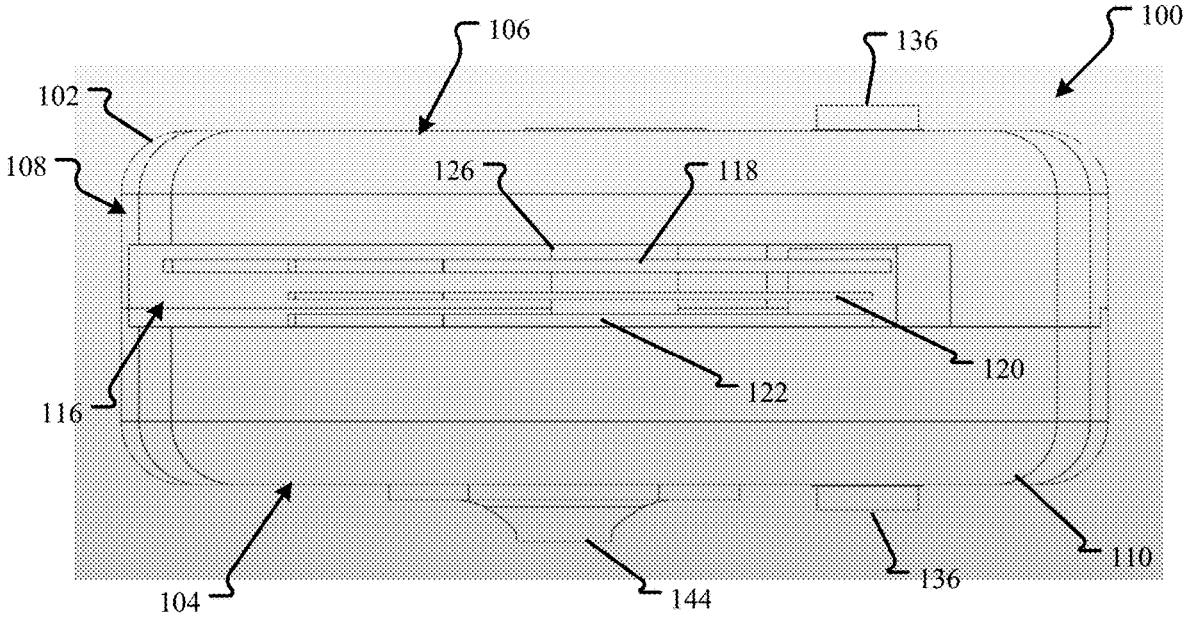
FIG. 6 illustrates a top view of the multi-blade utility tool in a closed and locked position.
Figure 7:
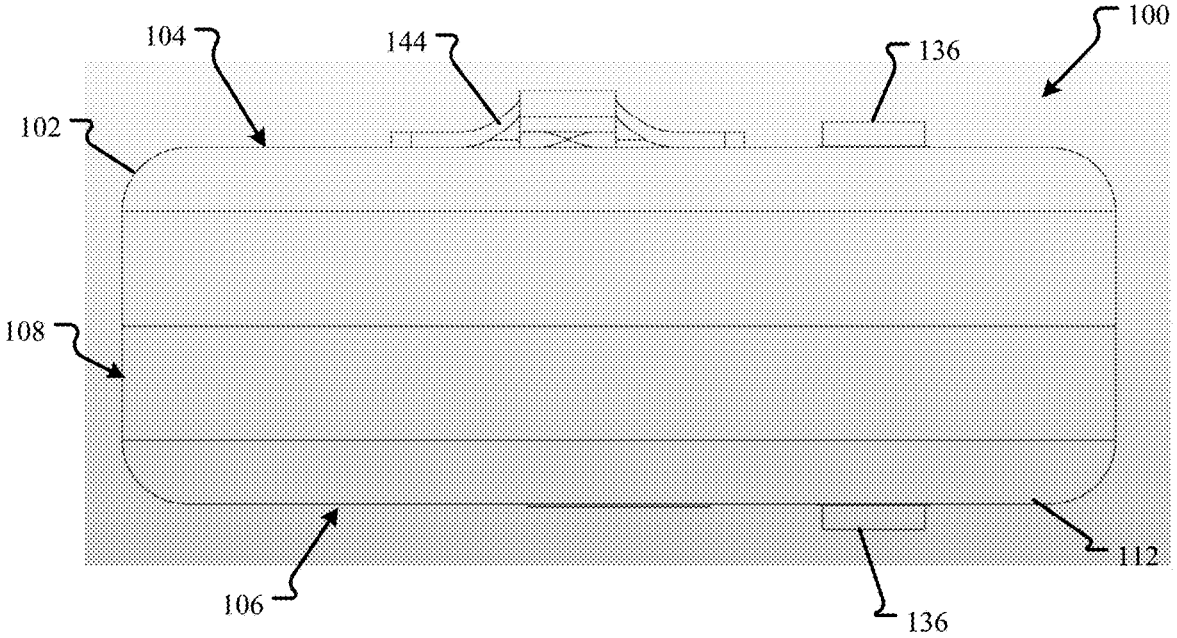
FIG. 7 illustrates a bottom view of the multi-blade utility tool in a closed and locked position.

FIG. 4 illustrates a left-side view of the multi-blade utility tool 100 in a closed and locked position. FIG. 5 illustrates a right-side view of the multi-blade utility tool 100 in a closed and locked position. FIG. 6 illustrates a top view of the multi-blade utility tool 100 in a closed and locked position. FIG. 7 illustrates a bottom view of the multi-blade utility tool 100 in a closed and locked position. Referring concurrently to FIGS. 4-7, a number of components are described above in reference to FIGS. 1-3, and thus, are not necessarily described further. In the example, the front side 104 is substantially parallel to the back side 106 of the assembly body 102. The opening 116 only extends through the right side of the assembly body 102 within the side surface 108 and the top end 110. By extending the opening 116 through the top end 110, the blades 118, 120, 122 can rotate approximately 180-degrees from the closed position (as shown) to the open position (shown in FIG. 10). Additionally, over rotation of the blade are prevented via the left side of the assembly body 102.

The extension 136 of the locking mechanism protrudes from the assembly body 102 on both the front side 104 and the back side 106. Additionally, the clip 144 has the elongated strip with curvature that protrudes away from the front side 104 of the assembly body 102, leaving a gap between a portion of the clip 144 and the front side 104 of the assembly body 102. Corners of the assembly body 102 may be rounded to prevent injury, snagging, or damage when in use.

The opening 116 is longer than the longest blade in the multi-blade utility tool 100 and thicker $T_1$ (shown in FIG. 1) than the combined thicknesses $T_2$ of the blades 118, 120, 122, to allow the blades to be housed in the assembly body 102 when in the closed position via the opening 116. The opening 116 through-extrudes the top end 110 of the assembly body 102, leaving the blades 118, 120, 122 accessible from the top end 110 of the assembly body 102. Although the opening 116 extrudes all the way through the top end 110, the opening 116 in this illustration does not extend through the opposite side of the side surface 108 beyond the widest portion of the assembly body 102. As shown, the blades 118, 120, 122 are spaced inside of the opening 116 so that no blade touches each other inside of the assembly body 102 in the closed position. For example, via one or more nylon washers. Additionally, the pivot pin 126 rotationally couples the blades 118, 120, 122 to the assembly body 102. The opening 116 does not extend to the proximate end 112 of the assembly body 102.

Figure 8:
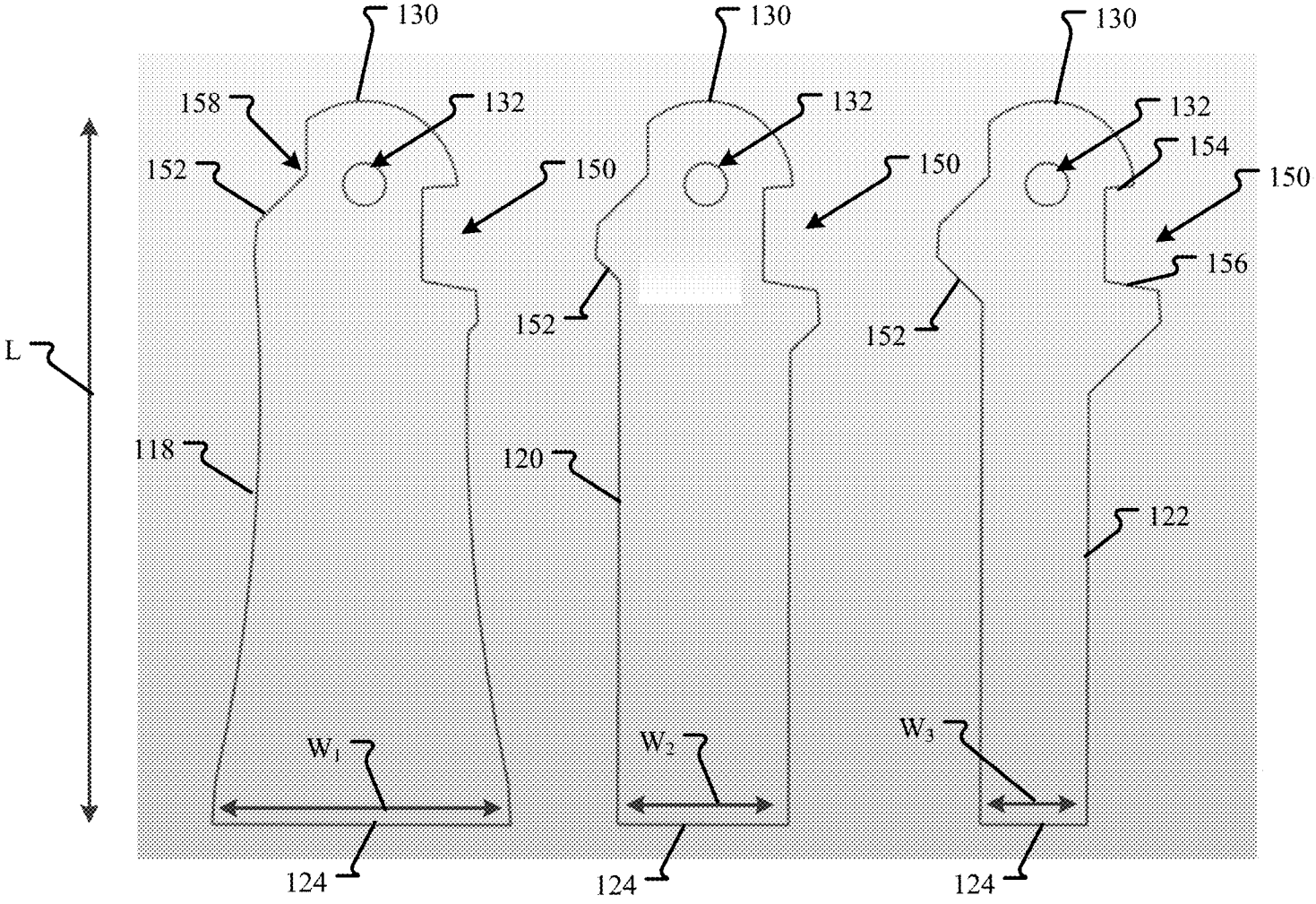
FIG. 8 illustrates an exploded view of an exemplary set of blades that may be used with multi-blade utility tool shown in FIGS. 1-7.

FIG. 8 illustrates an exploded view of the set of blades 118, 120, 122 that may be used with multi-blade utility tool 100 (shown in FIGS. 1-7). The blades 118, 120, 122 may be a variety of shapes and sizes to accommodate different purposes, such as scraping, paint prepping, or drywall finishing on different sized areas and surfaces. Each blade 118, 120, 122 has the pivot end 130, the distal end 124, and the bore 132 as described above. Additionally, each blade 118, 120, 122 has a securing notch 150 and a protrusion 152. The pivot end 130 of each blade is housed inside of the assembly body 102 in the top end 110 (shown in FIG. 1). In some examples, the pivot end 130 may be at least partially curved to match the top end of the assembly body. The distal end 124 may be used for various activities of a drywall blade. When the multi-blade utility tool 100 is in the closed position, the distal end 124 is housed near the proximate end 112 of the assembly body 102 (shown in FIG. 1). When the blade is in the open position, the distal end 124 extends from the assembly body. In the example, each blade 118, 120, 122 has a width W that is different. For example, but not limited to, a width W of approximately 1¾ inches, 1 inch, and ⅝ inch. In other examples, each width W may be approximately equal as required or desired.

The securing notch 150 is located proximate to the pivot end 130 disposed on the right side. The securing notch 150 forms a notch top edge 154, proximate the pivot end 130, and an opposite notch bottom edge 156 towards the distal end 124. When the blade in the closed position and the locking mechanism 134 (shown in FIG. 1) is locked, the blade engagement member 138 (shown in FIG. 1) is disposed within the securing notch 150 and engaged with the notch top edge 154. For example, the biasing force of the locking mechanism 134 urges the blade engagement member 138 against the pivot end 130 in a direction that counteracts the rotation of the blade out of the assembly body 102. This engagement prevents rotation of the blade out of the opening 116 in the assembly body 102 (shown in FIG. 1). Rotation of the blade in the other direction is blocked by the enclosed assembly body. As such, the blade is locked in the closed position and rotation is prevented.

When the locking mechanism 134 is moved into the unlocked configuration the blade engagement member 138 moves within the securing notch 150 and towards the notch bottom edge 156. This position of the locking mechanism 134 disengages the locking mechanism from the blade and positions the locking mechanism 134 so that upon rotation of the blade, the pivot end 130 is clear from the locking mechanism. Once unlocked, rotation of the blade occurs about the bore 132. The pivot pin 126 (shown in FIG. 1) extends through the bore 132 and allows rotation of the blade thereabout. Multiple blades (e.g., blades 118, 120, 122) may be coupled to the assembly body 102 in this manner, passing the pivot pin through multiple blade bores 132. Each blade may be independently rotated about the pivot pin, such that a user may choose which blade(s) to rotate to the open position from the closed position, or vice versa. In this example, the bore 132 is a circular hole extruded proximate the pivot end 130 of the blades. As an example, the pivot pin may be a cylindrical shaft that passes through the bore 132 while reducing friction upon rotation of the blades.

On the opposite side of the blade from the securing notch 150, each blade 118, 120, 122 includes the protrusion 152. The protrusion 152 forms a recess 158 that is configured to engage with the locking mechanism when the blade is in the open position. Upon rotation of the blade to the open or extended position, the blade engagement member 138 reengages with the blade when in the locked position so as to prevent rotation of the blade, unless the locking mechanism is actuated again.

In the example, each blade 118, 120, 122 may have a substantially equal length L. In other examples, one or more of the blade lengths may be different than another. The blades 118, 120, 122 can be flexible for drywall use. In other examples, the blades can be substantially rigid. In the example, the first blade 118 is shaped to flare outwardly from the pivot end 130 to the distal end 124 such that the pivot end 130 is narrower than the distal end 124.

FIG. 9 illustrates a perspective exploded view of the multi-blade utility tool 100. A number of components are described above in reference to FIGS. 1-8, and thus, are not necessarily described further. From this view, the internal components of the multi-blade utility tool 100 are more clearly shown. As an example, the rotational axis 128 is defined by the pivot pin 126 that receives each bore 132 of the blades 118, 120, 122 when all components are assembled in the multi-blade utility tool 100. The rotational axis 128 defines the axis about which each blade 118, 120, 122 may rotate between a closed position and open position of the multi-blade utility tool 100 as described herein.

In the example, the pivot pin 126 may be a two part fastener with a binding post 160 that is configured to receive a removable fastener 162. The binding post 160 extends along the rotational axis 128, and both the binding post 160 and the fastener 162 can have a flange 164. The binding post 160 may be removably coupled to the fastener 162 and allow a user of the multi-blade utility tool 100 to disassemble the assembly body 102 and remove or attach the blades. For example, the fastener 162 may be decoupled via screwing out of the binding post 160, thereby allowing the bore 132 of the blade(s) to slide on or off prior to reassembling the utility tool 100.

As previously described, the locking mechanism 134 includes the blade engagement member 138 coupled to the biasing element 142. A pair of extensions 136 also extend from one end of the blade engagement member 138 opposite of the biasing element 142. The top end of the blade engagement member 138 is configured to engage with the blades in the locked configuration in both the closed and open positions to prevent rotation of the blades about the rotational axis 128. In some examples, the extensions 136 may at least partially engage with the blades in the locked configuration as required or desired. The bottom end of the blade engagement member may be slidably received within an interior channel (shown in FIG. 12) within the assembly body 102 and coupled to the biasing element 142 (e.g., a compression spring).

One end of the biasing element 142 may be abutted against a static surface within the assembly body 102 to allow compression of the spring when force (e.g., an unlocking force) is applied against the other end (e.g., one or more of the extensions 136). The bottom end of the blade engagement member 138 may be positioned proximate the front side 104 of the assembly body 102 and to one side of the blades 118, 120, 122. Also shown in this illustration, the biasing element 142 frictionally fits into a fitting of defined within the bottom end of the blade engagement member 138.

FIG. 10 illustrates a front view the multi-blade utility tool 100 with the first blade 118 in an open and locked position. A number of components are described above in reference to FIGS. 1-9, and thus, are not necessarily described further. When one or more of the blades are in the open or extended position, the blade extends from the assembly body 102 and is oriented substantially parallel to the longitudinal axis 114. In some examples, the distal end 124 of the blade may be substantially centered with respect to the longitudinal axis 114. Additionally, the locking mechanism 134 is in the locked position (e.g., the blade engagement member 138 positioned towards the top of the channel 140) so that the blade 118 is prevented from rotating back towards the closed position, unless the locking mechanism 134 is unlocked. This open position enables a user to use the assembly body 102 as a handle and the blade 118 as tool for drywall construction, for example. Additionally in the open position, the securing notch 150 is rotated away from the locking mechanism 134, while the protrusion 152 (shown in FIG. 8) is engaged with the locking mechanism 134.

Figure 11:
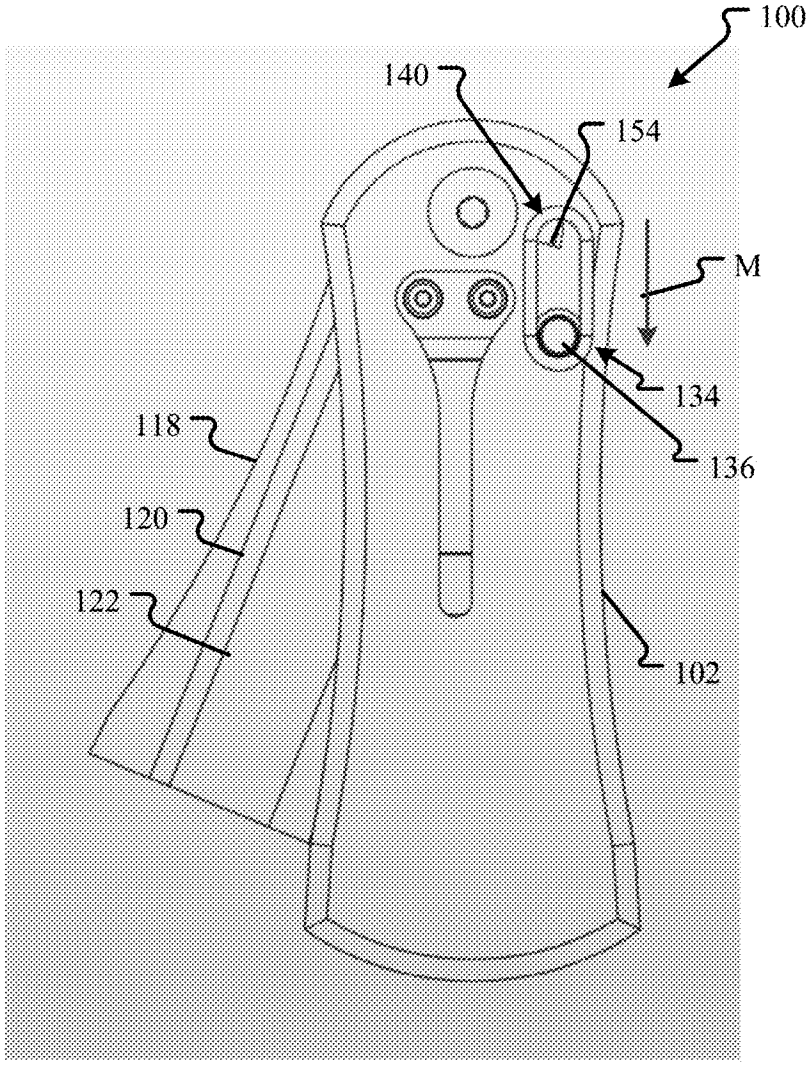
FIG. 11 illustrates a front view of the multi-blade utility tool in an unlocked position.

FIG. 11 illustrates a front view of the multi-blade utility tool 100 in an unlocked position. In operation, the extension 136 of the locking mechanism 134 is moved M within the assembly body 102 and towards the bottom end of the channel 140. This releases the locking mechanism 134 from the blades 118, 120, 122 so that one or more of the blades can rotate out of the assembly body 102. The movement M of the locking mechanism 134 disengages the blade engagement member 138 (shown in FIG. 9) from the notch top edge 154 of the blade. As described herein, the locking mechanism 134 is biased so as to automatically return to the locked position (e.g., shown in FIG. 1).

Figure 12:
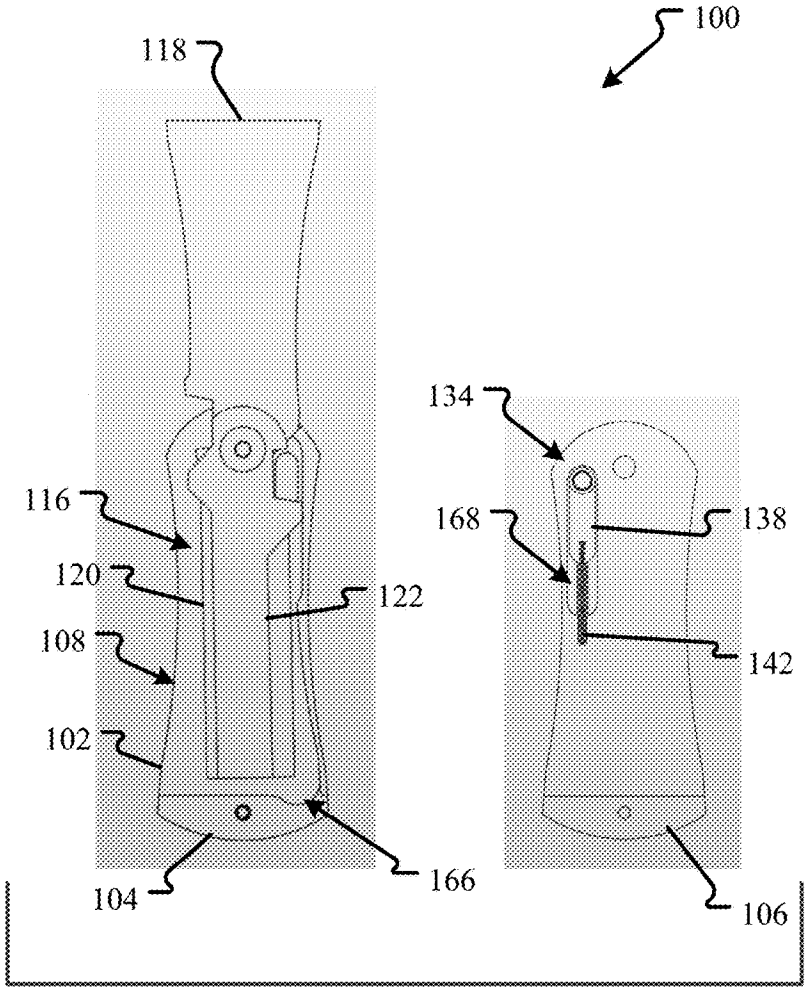
FIG. 12 illustrates an interior view of the multi-blade utility tool.

FIG. 12 illustrates an interior view of the multi-blade utility tool 100. The front side component 104 of the assembly body 102 at least partially defines the opening 116 that receives the blades 118, 120, 122. Opposite of the side surface 108, the opening 116 may include a bump-out 166 so that the opening 116 can fully receive each of the blades. The back side component 106 of the assembly body 102 includes an interior channel 168 that at least partially receives the locking mechanism 134. The interior channel 168 holds the biasing element 142 in place and allows the blade engagement member 138 to slide therein between the locked and unlocked positions.

Figure 13:
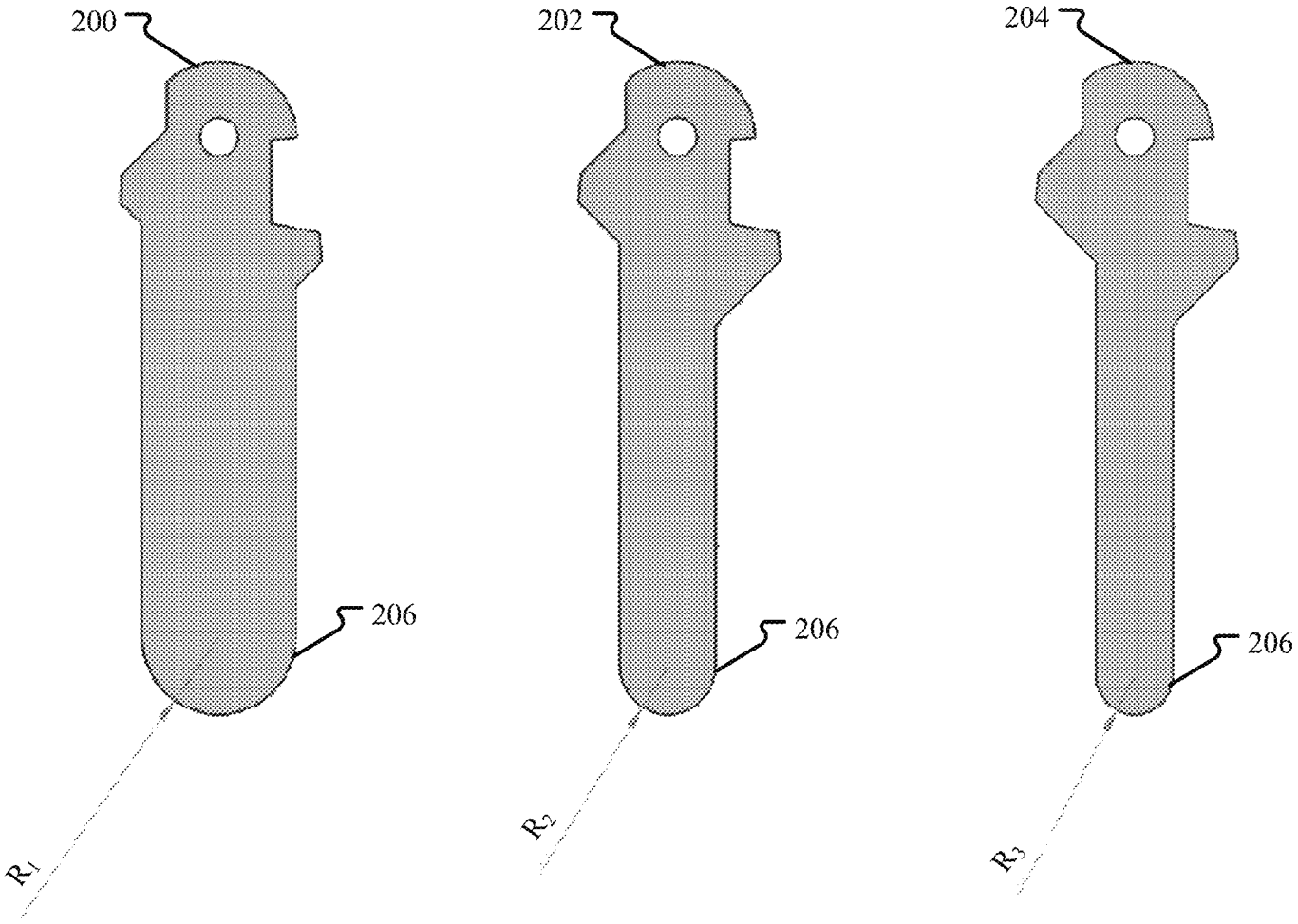
FIG. 13 illustrates an exploded view of another set of blades that may be used with multi-blade utility tool shown in FIGS. 1-7 and 9-12.

FIG. 13 illustrates an exploded view of another set of blades 200, 202, 204 that may be used with multi-blade utility tool 100 (shown in FIGS. 1-7 and 9-12). In this example, the blades 200, 202, 204 have substantially similar features of the blades described above in FIG. 8, however, a distal end 206 of each blade may be defined by a radius R. In this example, each blade 200, 202, 204 may have a different radius. For example, but not limited to, a radius R of approximately 0.5 inches, 0.31 inches, and 0.25 inches. In other examples, each radius R may be approximately equal as required or desired.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified examples and examples. In this regard, any number of the features of the different examples described herein may be combined into one single example and alternate examples having fewer than or more than all of the features herein described are possible.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed:

1. A utility tool comprising:

a body comprising:

a front side opposite a back side and at least one side surface disposed between the front side and the back side;

a top end opposite a proximate end; and an opening defined by the body, the opening extending through at least a portion of the at least one side surface;

a first blade having a pivot end and a distal end, the pivot end disposed within the opening and rotatably coupled to the top end such that the first blade is capable of being rotated about a rotational axis, wherein the first blade includes a securing notch, and further comprising a second blade having a second pivot end and a second distal end, the second pivot end disposed within the opening and rotatably coupled to the top end such that the second blade is capable of being rotated about the axis;

a channel disposed within the front side of the body, the channel extending from a top end of the channel along a path substantially parallel to a longitudinal axis to a bottom end of the channel, wherein the longitudinal axis is perpendicular to the rotational axis;

a blade engagement member disposed at least partially within the channel and slidable from the top end of the channel to the bottom end of the channel, and wherein:

positioning the blade engagement member at the top end of the channel causes the blade engagement member to engage with the securing notch of the first blade when the blade is in a closed position such that rotation of the blade is counteracted; and positioning the blade engagement member at the bottom end of the channel causes the blade engagement member to disengage with the securing notch of the first blade when the first blade is in the closed position such that rotation of the blade is not counteracted; and a biasing element consisting of a coiled spring compressible along the longitudinal axis and disposed parallel to the longitudinal axis within the body such that the coiled spring is disposed over the first blade when in a closed position and coupled to the blade engagement member.

2. The utility tool of claim 1, wherein the first blade flares outwardly from the pivot end to the distal end such that the pivot end is narrower than the distal end.

3. The utility tool of claim 1, wherein the first blade is rotatably coupled to the top end of the body via a pivot pin, the pivot pin comprising a binding post and a fastener, and wherein the first blade has a bore at the pivot end of the first blade that receives at least a portion of the binding post.

4. The utility tool of claim 1, wherein the first blade is at least 90% disposed within the body when the first blade is rotated about the axis to a closed position.

5. The utility tool of claim 1, further comprising a clip coupled to the front side of the body.

6. The utility tool of claim 1, wherein the blade engagement member has a first end and a second end, and the biasing element is coupled to the second end of the blade engagement member such that the biasing element provides a biasing force in a directional vector substantially parallel to the channel to cause, when in the closed position, at least a portion of the first end of the engagement member to engage with the securing notch to inhibit rotation when no counteracting force to the biasing force is present.

7. A utility tool comprising:

a body comprising a first end and an opposite second end extending along a longitudinal axis, wherein the longitudinal axis is perpendicular to a rotational axis;

an elongated opening defined within the body and extending from the first end towards the second end and substantially along the longitudinal axis;

a pivot pin disposed at the first end and extending at least partially through the opening, wherein the pivot pin defines the rotational axis;

at least one blade rotatably coupled to the first end at the pivot pin, wherein the at least one blade is moveable between a closed configuration and an extended position, and wherein in the closed configuration the at least one blade is disposed within the opening of the body, and in the extended position the at least one blade extends at least partially out of the opening of the body, wherein the at least one blade comprises a first blade, a second blade, and a third blade;

a locking mechanism comprising:

a biasing element consisting of a coiled spring disposed within the body such that the coiled spring is disposed over the at least one blade when in the closed configuration coupled to a blade engagement member, wherein the blade engagement member is moveable between a locked configuration and an unlocked configuration along the longitudinal axis, wherein in the locked configuration and closed configuration, moving the blade engagement member from the first end to the second end causes the blade engagement member to disengage with a first portion of the at least one blade such that rotation of the at least one blade is not counteracted, wherein in the locked configuration and extended position, moving the blade engagement member from the first end to the second end causes the blade engagement member to disengage with a second portion of the at least one blade opposite the first portion, wherein in the unlocked configuration, the blade engagement member disengages with the at least one blade such that the at least one blade is rotatable about the rotational axis out of the opening, and wherein the blade engagement member is biased towards the locked configuration.

8. The utility tool of claim 7, wherein the movement of the blade engagement member between the locked configuration and the unlocked configuration is substantially parallel to the longitudinal axis.

9. The utility tool of claim 7, wherein the biasing element comprises a compression spring.

10. The utility tool of claim 7, wherein the first portion comprises a securing notch.

11. The utility tool of claim 7, wherein the second portion of the at least one blade comprises a recess portion, and wherein the recess portion engages with the blade engagement member in the extended position.

12. The utility tool of claim 7, wherein a distal end of each of the three blades has a different width.

13. The utility tool of claim 12, wherein the distal end of each of the three blades are centered with respect to the pivot pin.

14. The utility tool of claim 7, wherein each of the three blades have a substantially equal length.

15. The utility tool of claim 7, wherein the at least one blade is flexible.

16. The utility tool of claim 7, wherein the at least one blade is completely disposed within the body when in the closed configuration.

17. The utility tool of claim 7, wherein the blade engagement member has a top end and a bottom end, and the biasing element is coupled to the bottom end of the blade engagement member such that the biasing element provides a biasing force in a directional vector substantially parallel to the longitudinal axis to cause, when in the extended position, at least a portion of the top end of the engagement member to engage with the second portion of the blade to inhibit rotation when no counteracting force to the biasing force is present.

* * * * *